United States Patent [19]

Lea

[11] 4,153,463

[45] May 8, 1979

[54] PHOTOTHERMOGRAPHIC EMULSIONS CONTAINING MAGENTA ACUTANCE DYES

[75] Inventor: Bernard A. Lea, Harlow, England

[73] Assignee: Minnesota Mining and Manufacturing Company, St. Paul, Minn.

[21] Appl. No.: 896,439

[22] Filed: Apr. 14, 1978

[30] Foreign Application Priority Data

Apr. 21, 1977 [GB] United Kingdom ..... 16677/77

[51] Int. Cl.[2] ..... G03C 1/02

[52] U.S. Cl. ..... 96/114.1; 96/84 R

[58] Field of Search ..... 96/114.1, 84 R

[56] References Cited

U.S. PATENT DOCUMENTS

| | | | |
|---|---|---|---|
| 3,988,156 | 10/1976 | Sturmer | 96/114.1 |
| 4,033,948 | 7/1977 | Brown | 96/114.1 |
| 4,088,497 | 5/1978 | Brown et al. | 96/114.1 |

*Primary Examiner*—Travis Brown

*Attorney, Agent, or Firm*—Cruzan Alexander; Donald M. Sell; Mark A. Litman

[57] ABSTRACT

Magenta acutance dyes for photothermographic emulsions are disclosed.

10 Claims, No Drawings

PHOTOTHERMOGRAPHIC EMULSIONS CONTAINING MAGENTA ACUTANCE DYES

This invention relates to photosensitive compositions and to the incorporation of acutance dyes in such systems. The invention is particularly concerned with photosensitive compositions of the type known as photothermographic or "dry silver" compositions.

Dry silver photosensitive compositions comprise an intimate mixture of a light-sensitive silver halide and another silver compound, usually an organic compound, such as a silver salt of an organic acid, particularly long chain fatty acids, e.g., silver behenate or silver saccharine, which upon reduction gives a visible change and which is substantially light-insensitive. Such a mixture is usually prepared in suspension and the resulting dispersion spread on a suitable substrate. When dry, the resulting layer is exposed to a light image and thereafter a reproduction of the image can be developed by heating the layer in the presence of a reducing agent such as hydroquinone or certain substituted phenols.

It is because the exposure and development of the layer occur without using water, that these materials are often referred to as dry silver light-sensitive materials. Examples of these dry silver materials are described in British Pat. No. 1,110,046 and U.S. Pat. Nos. 3,457,075 and 3,839,049 which describe a photothermographic material in which minor amounts of a photosensitive silver halide catalyst-progenitor are associated in catalytic proximity with major amounts of a heat-sensitive oxidation-reduction image forming reaction mixture which reacts more rapidly in the presence of the catalyst resulting upon exposure of the silver halide.

We believe, that when the mixture is exposed to light, a latent image is formed in the silver halide. Thereafter, the silver compound can be reduced by heating with the reducing agent for silver ion, this reduction being catalyzed image-wise by the silver in the light exposed silver halide. By a suitable choice of temperature, the reduction of the silver compound can be catalyzed in the light exposed areas to give a visible darkening while any slight reduction which occurs in the nonlight exposed areas is insufficient to give a marked change. Of course, because the silver halide acts as a catalyst progenitor, only small amounts of it are required, e.g. 0.1 to 20% by weight of the mixture, and preferably 0.1 to 10%.

In order to improve the sharpness or definition of photographic images a dye known as an acutance dye is often incorporated into photosensitive compositions. The acutance dye will absorb at the wavelengths at which the photosensitive composition is sensitive. It attenuates all the light passing into a layer of the light-sensitive composition, but the longer the path length of the light in the layer the greater the attenuation. Therefore, scattered light is attenuated or absorbed to a larger extent than light which impinges directly on a light-sensitive crystal. As a result therefore, although the overall speed of the composition is reduced slightly, scattered light and other light rays which are liable to produce a blurred image are preferentially absorbed and so the overall definition and sharpness of images produced in the layer are increased.

An acutance dye for use in a dry silver composition must be heat labile, that is to say, that it must be destroyed by the heat development of the dry silver composition to one or more compounds which are colorless. It is therefore an object of this invention to provide dry silver compositions which contain magenta acutance dyes, i.e. those which will absorb green light, the dyes being rendered colorless upon heat development of the dry silver composition.

According to the invention there is provided a light-sensitive composition comprising an intimate mixture of a substantially light-sensitive silver compound upon which reduction gives a visible change and sufficient of a silver halide to catalyze this reduction to give a visible change in those areas where the silver halide has been exposed to light when the mixture is heated in the presence of a reducing agent, and a magenta acutance dye having the general formula:

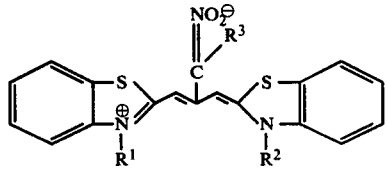

in which $R^1$ and $R^2$, which can be the same as or different from one another, each represents an alkyl group and in particular one containing from 1 to 12 carbon atoms, and $R^3$ represents a hydrogen atom or an alkyl group, preferably a lower alkyl group, e.g. of from 1 to 4 carbon atoms, preferably 1 to 2 carbon atoms, an aralkyl group such as a benzyl group, an aryl group such as a phenyl group or an electronegative group such as an ethoxycarbonyl, cyano or toluene-sulphonyl group.

It is found that dry silver compositions containing one of the above noted acutance dyes can give excellent sharp images and that the acutance dye will be rendered colorless by the heating required to develop the composition. This is surprising in view of the fact that these dyes are found not to be decomposed to a colourless state when they are heated on their own to the temperature at which the dry silver compositions are heated for development.

The acutance dyes in the compositions of the invention can be prepared in a manner analogous to the synthesis of 1:1-dicyano-2,2-bis(3-alkyl-2-benzothiazolinylidenemethyl)alkenes, (described in Chemical Abstracts 50, 12711a) by reacting a 3:3'-dialkyl-9-alkylthiothiacarbocyanine iodide with a nitroalkane or a substituted nitroalkane $R^3CH_2NO_2$ in which $R^3$ is as defined above.

Examples of acutance dyes which can be used according to the invention are those having the values of $R^1$, $R^2$ and $R^3$ as set out in the following Table 1.

Table 1

| Compound | $R^1$ | $R^2$ | $R^3$ | melting point °C. | $\lambda_{max}$ (nm) |
|---|---|---|---|---|---|
| 1 | $C_2H_5$— | $CH_3$— | H— | 190-205 (d) | 565 |
| 2 | $C_2H_5$— | $CH_3$— | $CH_3$— | 210 (d) | 568 |
| 3 | $CH_3$— | $CH_3$ | H | 195-205 (d) | 567 |
| 4 | $C_2H_5$— | $C_2H_5$— | $C_2H_5$— | 200 (d) | 565 |

Table 1-continued

| Compound | $R^1$ | $R^2$ | $R^3$ | melting point ° C. | $\lambda_{max}$ (nm) |
|---|---|---|---|---|---|
| 5 | $C_2H_5$— | $C_2H_5$— | H | 195-210 | 569 |
| 6 | $CH_3(CH_2)_{11}$— | $CH_3$— | H | 115-120 (d) 150 | 570 |
| 7 | $CH_3$ | $C_2H_5$— | $C_6H_5$— | 191-192 (d) | 567 |

(d) = with decomposition

The acutance dyes can be preferably incorporated into the compositions of the invention in an amount from $1\times10^{-3}$ to $3\times10^{-2}$ mole of acutance dye per kilogram of dry solids in the composition. Most preferably, however the dyes are incorporated in an amount of from $3\times10^{-3}$ to $1\times10^{-2}$ mole of acutance dye per kilogram of dry solids in the composition.

The light-sensitive compositions of the invention will normally be spread for use on a support, suitable supports including, for example, paper, polymeric film (e.g., polyester or polyamide film bases), and glass. The composition will normally be prepared as a solution or suspension which is spread as a layer on the support and then the solvent or vehicle is evaporated off to leave a dry photosensitive layer. If desired a coating aid or binder such as polyvinyl butyral, polymethyl methacrylate, cellulose acetate, polyvinyl acetate, cellulose acetate propionate and cellulose acetate butyrate, can be incorporated in the light-sensitive mixture.

The substantially light-insensitive silver compound is suitably a silver salt of an organic acid. Examples include silver behenate, silver caprate, silver laurate, silver myristate, silver palmitate, silver stearate, silver arachidate and silver saccharine.

The reducing agent for this substantially light-insensitive silver compound can normally be quite mild, and is well known in the photothermographic art. Suitable examples include hydroquinone and substituted phenols such as 1-methyl-4-hydroxy-naphthalene, methyl gallate, catechol, phenylenediamine, p-amino-phenol and 1-phenyl-3-pyrazolidone. The reducing agent can be incorporated into the light-sensitive composition. Alternatively, the composition can be placed in contact with the reducing agent after exposure to light. For example, a light-sensitive coating can be exposed to a light image, placed in contact with a layer containing the reducing agent and the image then developed by heating. Preferably, however, the reducing agent is incorporated in the light-sensitive composition before this is spread on the support. In this case, the storage stability of the composition can be improved by incorporating in the composition a small amount of a stabilizer such as an acid stabilizer, e.g. succinic acid, benzoic acid or salicylic acid.

The silver halide can be present in quite small amounts, e.g. 0.1 to 20% by weight of the mixture of silver compounds. It can be added as a preformed silver halide, precipitated in the vicinity of the light-insensitive silver compound or formed on the surface of the substantially light-insensitive compound or by adding a soluble halide, e.g. a mercury or sodium halide, to the substantially light-insensitive silver compound. The silver halide can, for example, be chloride, bromide or a mixture of them and/or other silver halides.

The light-sensitive compositions of the invention can include one or more sensitizing dyes to improve their sensitivity to parts of the spectrum other than the shorter wavelengths.

Examples of dry silver compositions according to the invention containing various acutance dyes were tested as follows, all parts being by weight unless otherwise indicated.

The test coatings were first prepared by charging to a mixing vessel at room temperature under room light a 500 gram dispersion containing 13.8 parts of silver behenate in 86.2 parts of solvent which in turn was comprised of 67 parts methyl ethyl ketone, 25 parts toluene and 7 parts methyl isobutyl ketone. Seven grams of polyvinyl butyral resin (butvar, B-76) was stirred in followed by 15 grams of 1-methyl-2-pyrrolidinone, and the whole stirred an additional 15 minutes.

Under Wratten 1A safelight, a mixture containing hydrobromic acid (20 ml, 1.0 molar in methanol) and hydroiodic acid (5 ml, 0.1 molar in methanol) was pipetted in with stirring. After 40 minutes at room temperature mercuric bromide solution (0.5 molar in methanol 3 ml) was added followed immediately by an additional 25 grams of polyvinyl butyral. After 20 minutes, a slurry of 3-ethyl-5[(1-ethyl-1,2-dihydroquinolinylidene-2)-ethylidene]-2(3-carboxymethyl-4-oxo-2-thio-5-thiazolidinylidene)-4-thiazolidone (Example 2, Dye B of U.S. Pat. No. 3,719,495) in methyl ethyl ketone (11.8 mg in 10 ml) was added, the mixture stirred for 10 minutes, allowed to stand for 60 minutes, then stirred an additional 10 minutes. With this addition the dispersion became pan sensitive and thereafter had to be handled under total darkness or satisfactory safelight, for example Wratten No. 11.

Equimolar amounts of the acutance dyes to be tested were charged to appropriate containers and dispersed in 3 ml of methyl ethyl ketone (MEK). Fifty gram aliquots of the light-sensitive dispersion prepared above were added, the mixture shaken, left to stand for 30 minutes, then shaken again prior to coating. Table 2 summarizes the amounts of each dye added to the light-sensitive dispersion to give compositions identified as I to VI as in Table 2.

Table 2

| Composition No. | Compound Added | Molecular Weight | mg/50g aliquot |
|---|---|---|---|
| I | None (control) | — | 3 ml MEK only |
| II | 1 | 409 | 19 |
| III | 2 | 464 | 22 |
| IV | 3 | 395 | 18 |
| V | 4 | 451 | 21 |
| VI | 6 | 536 | 25 |

Knife coatings 125 microns thick on polyester film were prepared from each of the light-sensitive compositions I to VI and dried for 4 to 5 minutes at 85° C. These dried coatings were then over-coated with the knife set 60 microns above the base and dried as before. The overcoat solution contained 81 parts methyl ethyl ketone, 5 parts methanol, 1.5 parts phthalazinone, 7.5 parts of bis(2,2'-dihydroxy-3,3',5,5'-tetramethyldiphenyl)(2,4,4-trimethylpentyl)methane and 5 parts of vinyl chloride/vinyl acetate copolymer (50/50 weight percent).

The performance of the resulting coatings of these compositions I to VI was then evaluated.

A combination of tungsten source, narrow band filter, and aperture target overlaid with a 0 to 4 continuous density wedge in a vacuum frame was used to make contact exposures at a wavelength closely matching the spectral absorbance maximum of each dye. Microdensitometer traces across the width of the image at D=2.0 (obtained after processing the exposed strips 15 seconds at 127° C. in an inert fluorochemical bath to give reproducible heating for these tests) were used to judge the effectiveness of each dye. The "widths" reported are those units of chart paper grid recorded as the microdensitometer moved from a point 0.05 above Dmin across D=2.0 and back to 0.05 above Dmin of the image. The absolute width of the target was 5.50±0.05 mm.

The results of testing the compositions are given below in Table 3.

Table 3

| Coating of Composition No. | Wave-length Exposed (nm) | Maximum Density | Image Width | Target Width | Ratio |
|---|---|---|---|---|---|
| I | 560 | 2.00 | 254.0 | 142.5 | 1.78 |
| III | 560 | 2.00 | 171.3 | 140.7 | 1.22 |
| IV | 560 | 1.92 | 208.0 | 141.0 | 1.47 |
| I | 580 | 2.00 | 258.0 | 140.7 | 1.83 |
| II | 580 | 2.00 | 171.0 | 140.5 | 1.22 |
| IV | 580 | 2.07 | 164.0 | 141.0 | 1.16 |
| VI | 580 | 2.04 | 166.0 | 141.5 | 1.17 |

In an ideal case the image width would equal the target width and so the ratio would be 1.0. However, as can be seen from Table 3, the ratios for coatings II to VI according to the invention are significantly closer to 1.0 than for the control coating I.

Once the coatings had been processed it was found that each of the dyes was substantially destroyed leaving film with an essentially neutral background.

What is claimed is:

1. A photothermographic emulsion comprising a light-insensitive organic silver salt which upon reduction produces a visible change, silver halide in an amount sufficient so that when struck by light it can catalyse the reduction of said organic silver salt, and a reducing agent for silver ions, said emulsion characterized by containing a magenta acutance dye of the formula:

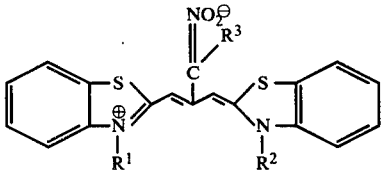

in which $R^1$ and $R^2$ independently represent an alkyl group, and $R^3$ represents a hydrogen atom or an alkyl group, an aralkyl group, an aryl group or an electronegative group.

2. An emulsion as claimed in claim 1 in which the electronegative group represented by $R^3$ is chosen from ethoxycarbonyl, cyano and toluene-sulphonyl groups.

3. A photothermographic emulsion comprising a light-insensitive organic silver salt which upon reduction produces a visible change, silver halide in an amount sufficient so that when struck by light it can catalyze the reduction of said organic silver salt, and a reducing agent for silver ions, said emulsion characterized by containing a magenta acutance dye of the formula:

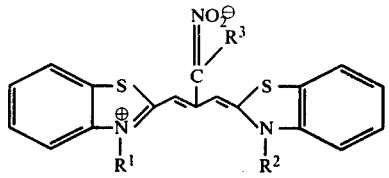

in which $R^1$ and $R^2$ independently represent an alkyl group, and $R^3$ represents a hydrogen atom or an alkyl group of 1 to 4 carbon atoms.

4. A light-sensitive composition as claimed in any of claims 1 to 3 in which $R^1$ and $R^2$ each represents an alkyl group containing from 1 to 12 carbon atoms.

5. A light-sensitive composition as claimed in any of claim 1 in which the acutance dye is present in an amount of from $1\times10^{-3}$ to $3\times10^{-2}$ mole per kilogram of dry solids in the composition.

6. A light-sensitive composition as claimed in claim 3 in which the acutance dye is present in an amount of from $3\times10^{-3}$ to $1\times10^{-2}$ mole per kilogram of dry solids in the composition.

7. A light sensitive emulsion as claimed in claim 1 in which the dye is selected from the class consisting of:

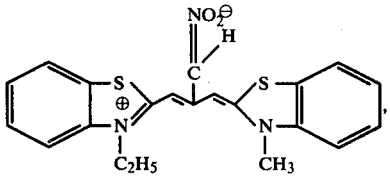

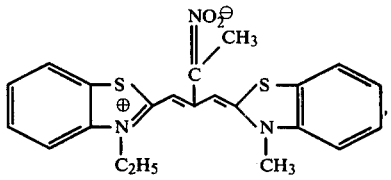

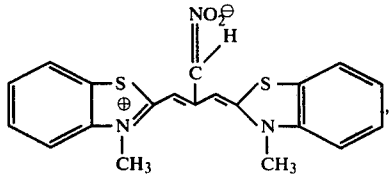

-continued
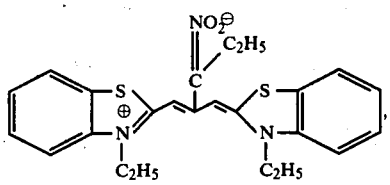
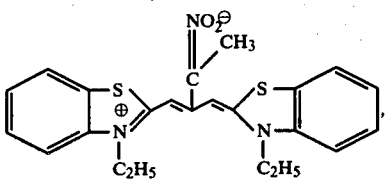
, or
-continued
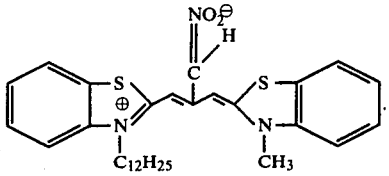
8. A light-sensitive emulsion as claimed in claim 1 in which the dye has the formula:
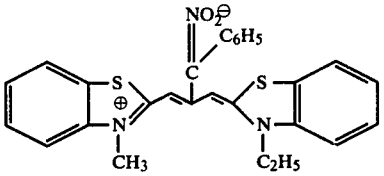
9. A light-sensitive material comprising the emulsion of claim 1 coated onto a substrate.
10. A light-sensitive material comprising the emulsion of claim 3 coated onto a substrate.
* * * * *